US007524414B1

(12) United States Patent
Barragan

(10) Patent No.: US 7,524,414 B1
(45) Date of Patent: Apr. 28, 2009

(54) APPARATUS FOR FILTERING OUT AND COLLECTING DEBRIS AT A STORM DRAIN

(76) Inventor: Candelario Barragan, 812 First St., Suite B, Brentwood, CA (US) 94513

( * ) Notice: Subject to any disclaimer, the term of this patent is extended or adjusted under 35 U.S.C. 154(b) by 0 days.

(21) Appl. No.: 11/805,125

(22) Filed: May 22, 2007

(51) Int. Cl.
*E03F 5/06* (2006.01)

(52) U.S. Cl. ..... 210/163; 210/164; 210/170.03; 210/337; 210/434; 210/474; 404/4

(58) Field of Classification Search ..... 210/155, 210/162, 163, 164, 170.03, 238, 335, 337, 210/434, 470, 474; 404/4, 5
See application file for complete search history.

(56) References Cited

U.S. PATENT DOCUMENTS

| | | | | |
|---|---|---|---|---|
| 3,713,539 | A * | 1/1973 | Thompson et al. | 210/164 |
| 4,419,232 | A * | 12/1983 | Arntyr et al. | 210/164 |
| 5,788,849 | A | 8/1998 | Hutter, Jr. et al. | |
| 5,820,762 | A | 10/1998 | Bamer et al. | |
| 5,849,198 | A | 12/1998 | Sharpless | |
| 5,954,952 | A * | 9/1999 | Strawser, Sr. | 210/164 |
| 5,958,226 | A | 9/1999 | Fleischmann | |
| 6,086,758 | A | 7/2000 | Schilling et al. | |
| 6,178,565 | B1 | 1/2001 | Franco | |
| 6,214,216 | B1 * | 4/2001 | Isaacson | 210/162 |
| 6,294,095 | B1 | 9/2001 | Lewis | |
| 6,531,059 | B1 | 3/2003 | Morris et al. | |
| 6,537,446 | B1 | 3/2003 | Sanguinetti | |
| 6,537,447 | B2 * | 3/2003 | Remon | 210/163 |
| 6,562,233 | B1 | 5/2003 | Schilling et al. | |
| 6,666,974 | B2 | 12/2003 | Page | |
| 6,805,804 | B2 | 10/2004 | Page | |
| 7,052,207 | B1 | 5/2006 | Wimberger | |
| 7,074,326 | B2 | 7/2006 | Singleton | |
| 7,112,274 | B1 | 9/2006 | Sanguinetti | |
| 2004/0065601 | A1 * | 4/2004 | Martinez | 210/163 |
| 2008/0073277 | A1 * | 3/2008 | Paoluccio et al. | 404/4 |

* cited by examiner

*Primary Examiner*—Christopher Upton
(74) *Attorney, Agent, or Firm*—Thomas R. Lampe

(57) ABSTRACT

Apparatus for filtering out and collecting debris at a storm drain includes upper and lower assemblies, each including a frame member and a filter member. Water passing through or alongside the filter member of the upper assembly is directed into the filter member of the lower assembly.

4 Claims, 3 Drawing Sheets

APPARATUS FOR FILTERING OUT AND COLLECTING DEBRIS AT A STORM DRAIN

TECHNICAL FIELD

This invention relates to storm drains and more particularly to apparatus for filtering out and collecting leaves, trash and other debris at a street storm drain so that only clean water free of debris enters the storm drain system.

BACKGROUND OF THE INVENTION

A number of approaches have been devised and employed for filtering and collecting debris at storm drains. One commonly employed technique is to place a mesh sheet of plastic or other material under the grating of a street storm drain to collect debris. The exposed edges of the mesh sheet project outwardly from the grating and sand bags are often utilized to hold the exposed edges in place. The mesh sheet under the grating bulges downwardly, essentially creating a bag or receptacle for receiving debris and allowing water to flow through the sheet into the storm drain system. This approach is unsightly and has other disadvantages, not the least of which is the intensive labor involved to install and maintain the structure. Also, the obstruction created by the sand bags interferes with sweeping and other street maintenance and can even cause vehicular accidents. Retrieval and emptying of the mesh sheet with accumulated trash has attendant problems as well, not the least of which is the spillage of debris which often occurs. Furthermore clogging of the single mesh sheet can readily occur, resulting in backup of both water and debris into the street, causing flooding.

A number of arrangements have been devised which are employed at storm drains for the purpose of filtering and collecting debris. Systems of this type which are believed to be representative of the current state of the art in this field are disclosed in the following patents: U.S. Pat. No. 5,849,198, issued Dec. 15, 1998, U.S. Pat. No. 5,820,762, issued Oct. 13, 1998, U.S. Pat. No. 5,958,226, issued Sep. 28, 1999, U.S. Pat. No. 5,788,849, issued Aug. 4, 1998, U.S. Pat. No. 6,086,758, issued Jul. 11, 2000, U.S. Pat. No. 6,178,565, issued Jan. 30, 2001, U.S. Pat. No. 6,294,095, issued Sep. 25, 2001, U.S. Pat. No. 6,531,059, issued Mar. 11, 2003, U.S. Pat. No. 6,537,446, issued Mar. 25, 2003, U.S. Pat. No. 6,562,233, issued May 13, 2003, U.S. Pat. No. 6,666,974, issued Dec. 23, 2003, U.S. Pat. No. 6,805,804, issued Oct. 19, 2004, U.S. Pat. No. 7,052,207, issued May 30, 2006, U.S. Pat. No. 7,074,326, issued Jul. 11, 2006 and U.S. Pat. No. 7,112,274, issued Sep. 26, 2006.

The prior art systems do not or teach or suggest the unique combination of structural elements and cooperative relationships therebetween of the apparatus disclosed and claimed herein, such apparatus being efficient, effective, easy to install, maintain and remove, with consequent labor savings and other advantages.

DISCLOSURE OF INVENTION

The apparatus of the present invention is incorporated in a storm drain to filter out and collect debris at the storm drain. The storm drain defines a storm drain interior and a storm drain opening communicating with the storm drain interior.

The apparatus includes a first frame member defining a first frame member opening, the first frame member supported by the storm drain with the first frame opening in communication with the storm drain opening.

The apparatus also includes a first filter connected to the first frame member and extending downwardly therefrom below the first frame member opening. The first filter member is positioned in the storm drain interior.

The apparatus further includes a second frame member defining a second frame member opening, the second frame member positioned above the first frame member with the second frame member opening in communication with the storm drain opening and with the first frame member opening.

A second filter member is connected to the second frame member and extends downwardly therefrom below the second frame member opening. The second filter member is positioned in the storm drain interior over the first filter member.

Other features, advantages and objects of the present invention will become apparent with reference to the following description and accompanying drawings.

BEST MODE FOR CARRYING OUT THE INVENTION

Figure 1:
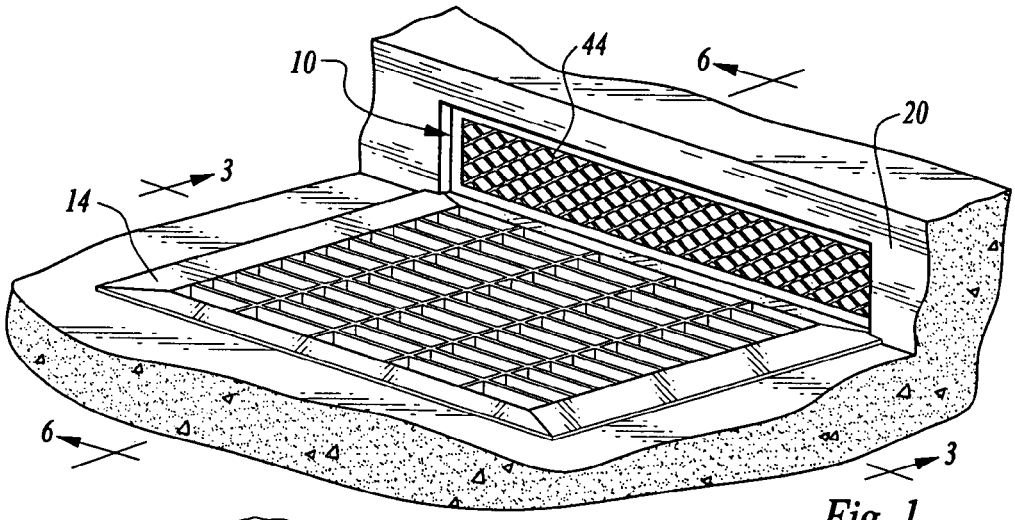
FIG. 1 is a perspective view illustrating a curbside street storm drain with apparatus constructed in accordance with the teachings of the present invention installed.
Figure 2:
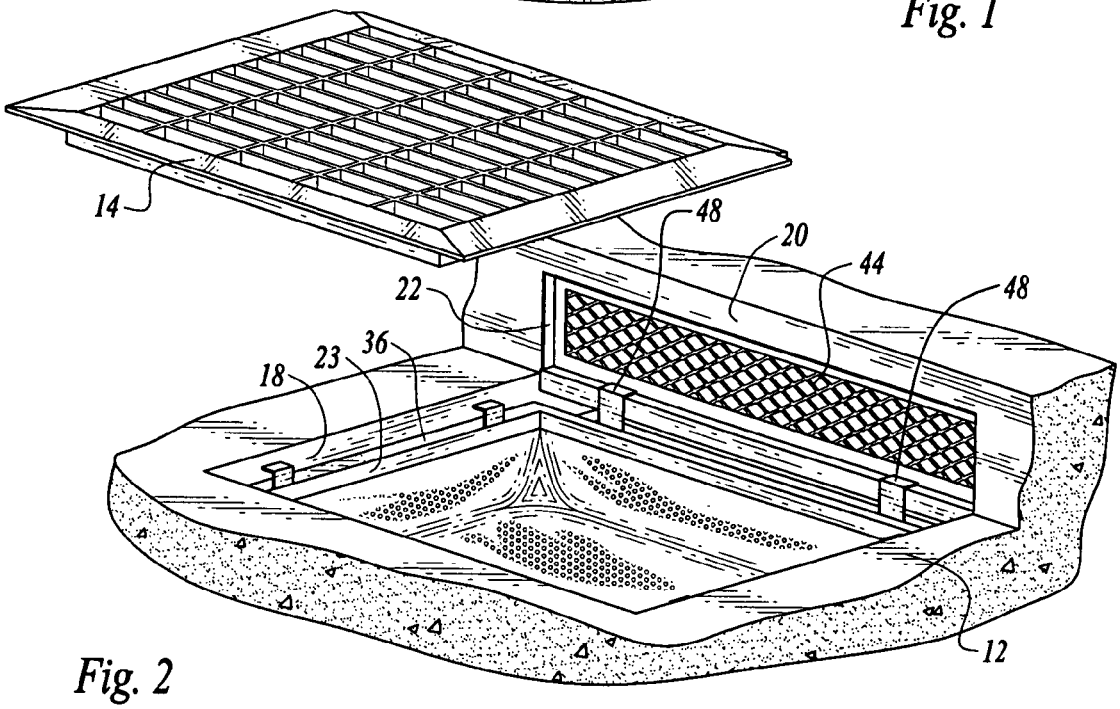
FIG. 2 is a view similar to FIG. 1, but illustrating a grate having been removed to illustrate structural features of the apparatus.
Figure 3:
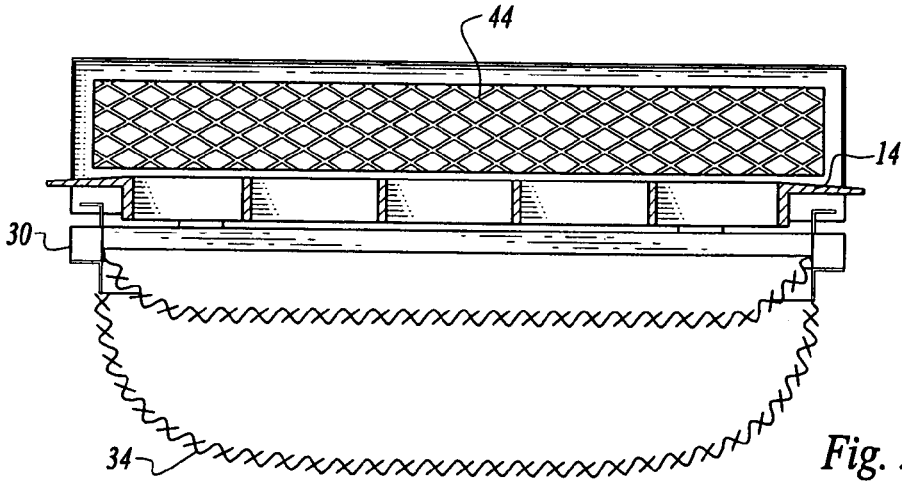
FIG. 3 is a cross-sectional view of the apparatus taken along the line 3-3 of FIG. 1.
Figures 4, 5:
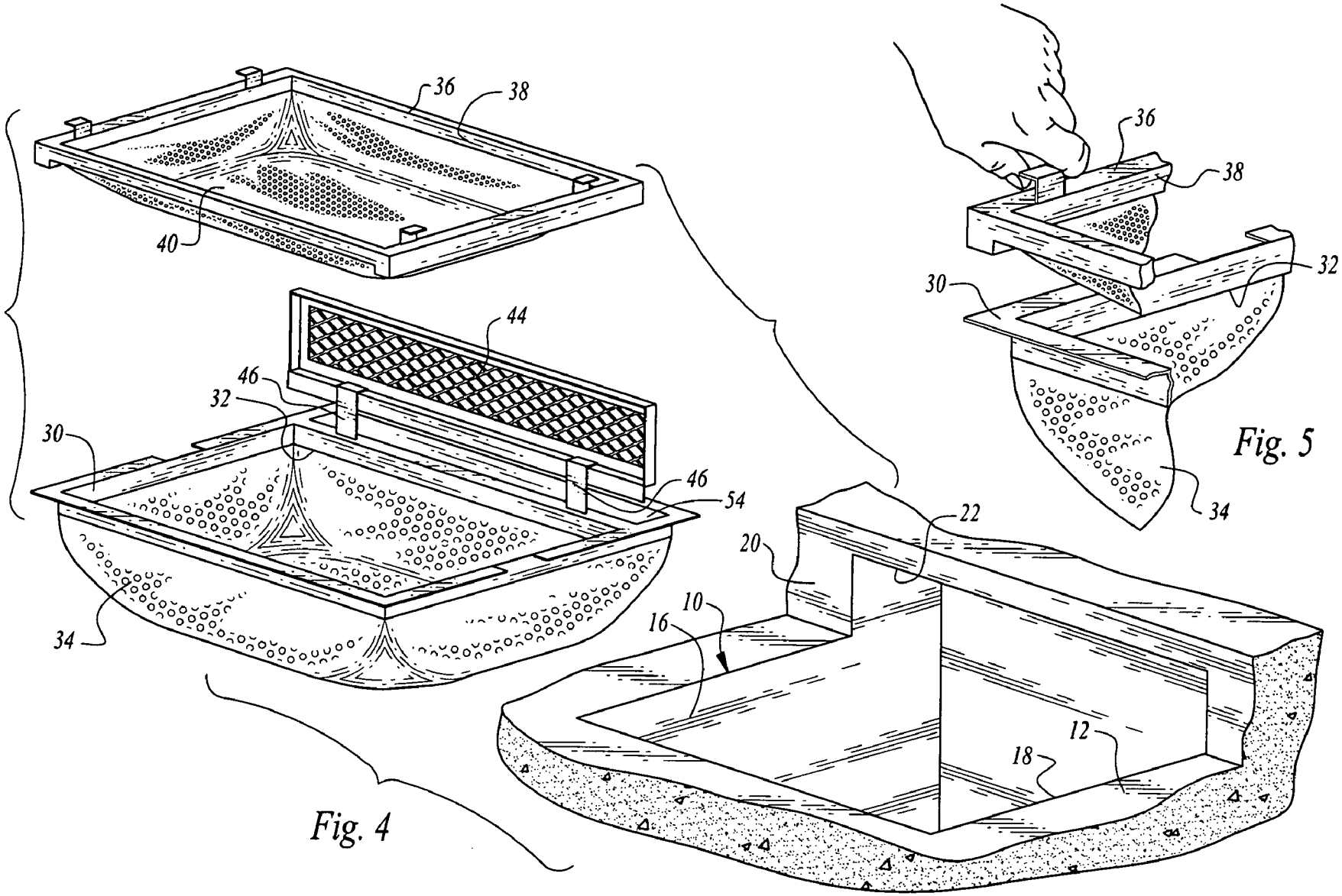
FIG. 4 is an exploded, perspective view illustrating the storm drain with storm drain opening and storm drain interior exposed, and two separable components or assemblies of the apparatus prior to installation at the storm drain.
FIG. 5 is a partial, perspective view illustrating an upper frame member of the apparatus being positioned on a lower frame member.

Referring now to the drawings, a typical conventional curbside storm drain 10 is illustrated, the storm drain including drain box structure 12 and a grate 14.

The storm drain defines a storm drain interior 16 and a storm drain opening 18 communicating with the storm drain interior in conventional fashion so that water can flow through the grate and into the storm drain interior.

A curb 20 of a conventional nature extends upwardly from the street, storm drain opening 18 having a portion thereof forming curb face drain opening 22.

The apparatus of the present invention is for use with the storm drain to filter out and collect debris at the storm drain.

The apparatus includes a lower or first frame member 30 defining a first frame member opening 32. When installed in place on the drain box structure, the frame member 30 is supported thereby with the opening 32 in communication with storm drain opening 18.

A second component of the assembly including first frame member 30 is a first or lower filter member 34 attached to the first frame member and extending downwardly therefrom below first frame member opening 32 to form a debris receptacle. The filter member 34 is formed of foraminous sheet material, suitably plastic mesh sheet material of any other suitable sheet material defining openings may be utilized.

A second assembly includes a second or upper frame member 36 defining a second frame member opening 38. A second or upper filter member 40 is attached to frame member 36 and extends downwardly therefrom below the second frame member opening to form a debris receptacle.

The second frame member 36 is positioned on and supported by the first frame member 30 in the drain box structure. The second frame member opening 38 is in communication with both the storm drain opening 18 and the first frame member opening 32. The first and second frame members tilt downwardly in the direction of the curb.

The second filter member 40 is also formed of foraminous sheet material, suitably but not necessarily plastic mesh sheet material, defining openings. In the illustrated preferred embodiment, the openings of the mesh sheet material of the second or upper filter member are smaller than the openings of the mesh sheet material of the first or lower filter member.

Another component of the unitary assembly including lower frame member 30 and lower filter member 34 is a screen 44 for covering the curb face drain opening 22 upon installation of the frame member 30 in the interior of the drain box structure. The screen is supported by support elements or brackets 46 attached to the first frame member. The support elements 46 form grate support ledges 48 for supporting grate 14.

A gap 52 is formed between the drain box structure and the ends of the frame members 30, 36 under the curb. The second or upper frame member 36 is smaller than the first or lower frame member 30, the tilt of the first and second frame members causing overflow from the second filter member to be directed through gap 52 into the first or lower filter member. The first frame member 30 defines a space 54 for receiving the overflow from the first filter member.

Figure 6:
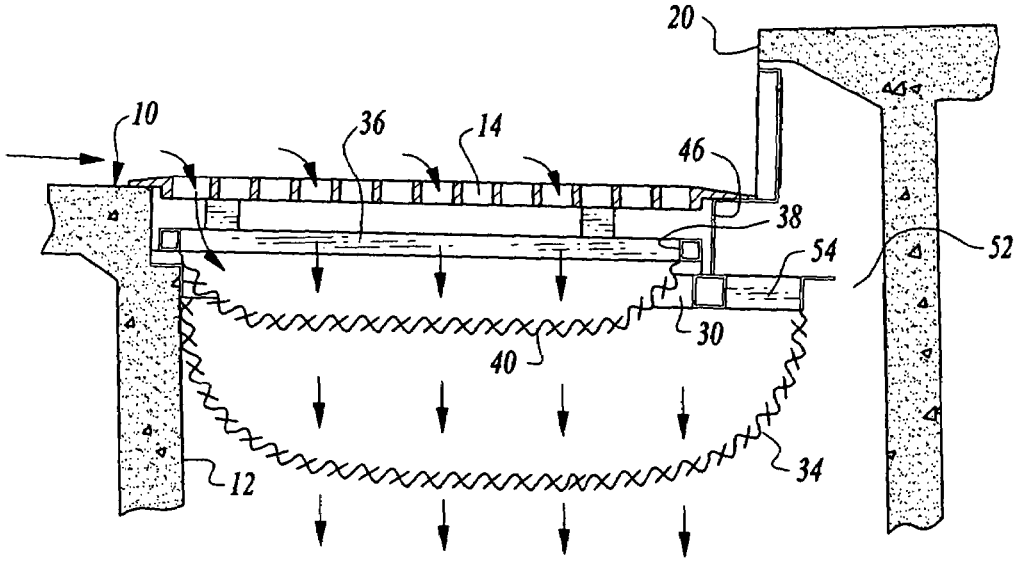
FIG. 6 is a cross-sectional, diagrammatic representation taken along line 6-6 of FIG. 1, illustrating drain water flow through the apparatus and storm drain interior.
Figure 7:
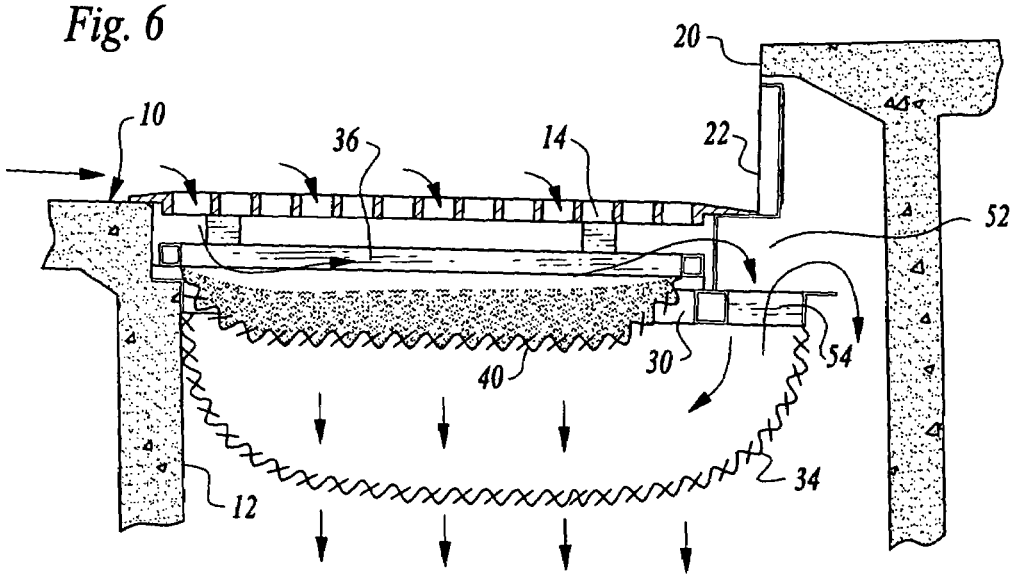
FIG. 7 is a view similar to FIG. 6, but illustrating water flow including overflow from an upper filter member depending from the upper frame member into a lower filter member attached to the lower frame member and through the storm drain interior.

FIG. 6 depicts flow of water and any debris entrained thereby by means of arrows. In FIG. 6, both the upper and lower filter members are empty and the water flows downwardly from the grate 14 through filter member 40 and thence through the lower filter member 34 directly. In FIG. 7, debris of one form or the other has been collected by the upper or second filter member to a degree that the debris essentially fills that filter member. While some water may still exit downwardly through the upper filter member 40, the accumulated debris will cause overflow to run over the end of the tilted upper filter member 40 closest to the curb and thence downwardly through gap 52 and into lower filter member 34 through space 54 of the lower frame member. FIG. 7 also shows that some of the excess overflow can also cause a degree of overflow from the lower filter member and directly into the storm drain interior through gap 52.

Figure 8:
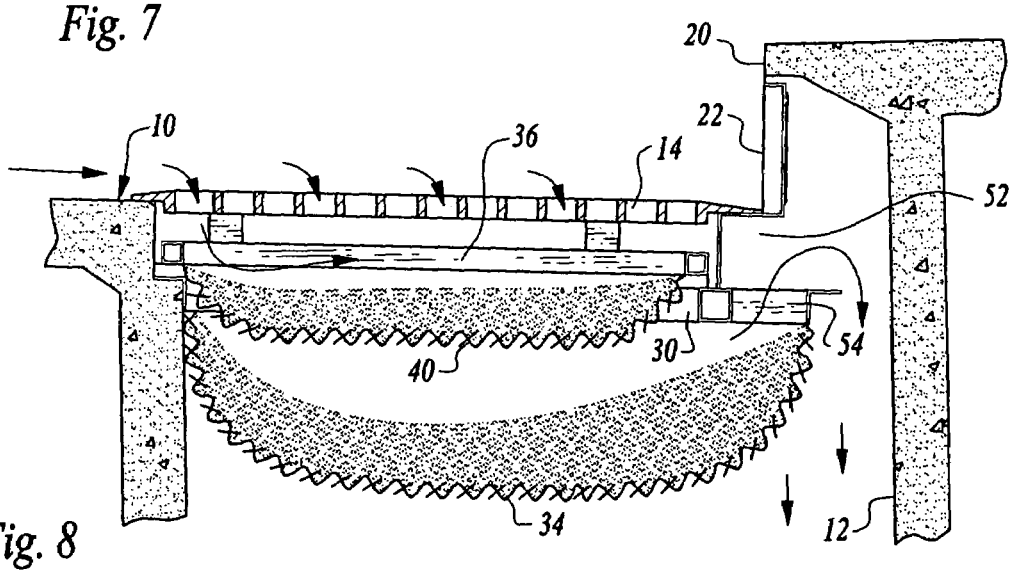
FIG. 8 is a view similar to FIGS. 6 and 7, but illustrating water flow in the form of overflow from the full lower filter member.

FIG. 8 shows a condition where both of the filter members are essentially full and clogged with debris, thus downward flow is essentially all overflow which proceeds downwardly through gap 52 into the drain box structure.

The upper subassembly comprising the frame member 36 and filter member 40 may be thought of as being the primary filter structure of the apparatus, the small opening mesh screen employed tending to trap both large and small debris particles or elements. Thus, flow to the lower assembly comprised of frame member 30 and filter member 34 will not begin until the latter stages of filling of the upper assembly with debris. Routine periodic removal and emptying of the upper assembly through use of handles 60 can be readily accomplished and if done within reasonable time intervals there will be no need to remove the lower assembly comprised of frame member 30 and filter member 34. However, the lower assembly acts as a backup and it too can readily be removed, emptied and placed back in position.

The invention claimed is:

1. Apparatus incorporated in a curbside storm drain defining a storm drain interior and a storm drain opening including a curb face drain opening communicating with said storm drain interior, said apparatus for filtering out and collecting debris from said storm drain, said apparatus comprising, in combination:

a first frame member defining a first frame member opening, said first frame member supported by said storm drain with said first frame member opening in communication with said storm drain opening;

a first filter member connected to said first frame member and extending downwardly therefrom below said first frame member opening, said first filter member being positioned in said storm drain interior;

a second frame member defining a second frame member opening, said second frame member positioned directly on said first frame member and supported by said first frame member, with said second frame member opening in communication with said storm drain opening and with said first frame member opening;

a second filter member connected to said second frame member and extending downwardly therefrom below said second frame member opening, said second filter member being positioned in said storm drain interior over said first filter member, said first and second filter members being substantially wholly comprised of foraminous sheet material and the foraminous sheet material of said first filter member spaced from the foraminous sheet material of said second filter member and said first filter member being larger than said second filter member;

screen support structure rigidly attached to said first frame member and extending upwardly therefrom, said screen support structure forming a grate support edge;

a screen rigidly supported by said screen support structure covering said curb face drain opening; and a grate supported by said grate support edge.

2. The apparatus according to claim 1 wherein said first frame member defines a space for receiving overflow from said first filter member and directing said overflow to said storm drain interior.

3. The apparatus according to claim 2 wherein a gap is located between said storm drain and said first frame member, overflow from the space defined by first frame member flowing into said gap.

4. Apparatus incorporated in a storm drain defining a storm drain interior and a storm drain opening communicating with said storm drain interior, said apparatus for filtering out and collecting debris from said storm drain, said apparatus comprising, in combination:

a first frame member defining a first frame member opening, said first frame member supported by said storm drain with said first frame member opening in communication with said storm drain opening;

a first filter member connected to said first frame member and extending downwardly therefrom below said first frame member opening, said first filter member being positioned in said storm drain interior;

a second frame member defining a second frame member opening, said second frame member positioned above said first frame member with said second frame member opening in communication with said storm drain opening with said first frame member opening; and a second filter member connected to said second frame member and extending downwardly therefrom below said second frame member opening, said second filter member being positioned in said storm drain interior over said first filter member, said second frame member being in engagement with and supported by said first frame member and said second frame member being smaller than said first frame member, said first and second frame members forming a gap with said storm drain for receiving overflow from said second filter member and directing said overflow into said first filter member.

* * * * *